United States Patent [19]

Cochran et al.

[11] 4,053,303

[45] Oct. 11, 1977

[54] METHOD OF CARBOTHERMICALLY PRODUCING ALUMINUM-SILICON ALLOYS

[75] Inventors: C. Norman Cochran, Oakmont; Subodh K. Das, Natrona Heights; Richard A. Milito, Natrona, all of Pa.

[73] Assignee: Aluminum Company of America, Pittsburgh, Pa.

[21] Appl. No.: 747,999

[22] Filed: Dec. 6, 1976

[51] Int. Cl.[2] ..... C22B 21/02

[52] U.S. Cl. ..... 75/68 A; 75/10 A

[58] Field of Search ..... 75/10 R, 68 R, 68 A

[56] References Cited

U.S. PATENT DOCUMENTS

| | | | |
|---|---|---|---|
| 3,254,988 | 6/1966 | Schmidt et al. | 75/68 R |
| 3,257,199 | 6/1966 | Schmidt | 75/68 R |
| 3,615,347 | 10/1971 | Schmidt et al. | 75/10 R |
| 3,655,362 | 4/1972 | Schmidt et al. | 75/68 A |
| 3,661,561 | 5/1972 | Frey et al. | 75/68 A |
| 3,661,562 | 5/1972 | Seth | 75/68 A |
| 3,758,289 | 9/1973 | Wood | 75/10 R |
| 3,892,558 | 7/1975 | Ilinkov et al. | 75/10 R |

*Primary Examiner*—M. J. Andrews
*Attorney, Agent, or Firm*—Andrew Alexander

[57] ABSTRACT

Aluminum-silicon alloys are formed by bringing a mix containing sources of alumina, silica and carbon to a temperature in the range of 1500° and 1600° C to form silicon carbide and carbon monoxide. The mix containing the silicon carbide is then brought to a temperature in the range of 1600° to 1900° C to form aluminum oxycarbide and carbon monoxide. Thereafter, the mix containing the silicon carbide and aluminum oxycarbide is brought to a temperature in the range of 1950° to 2200° C to produce an aluminum-silicon alloy.

25 Claims, No Drawings

METHOD OF CARBOTHERMICALLY PRODUCING ALUMINUM-SILICON ALLOYS

INTRODUCTION

This invention relates to aluminum-silicon alloys and more particularly it relates to the carbothermic production of aluminum-silicon alloys from alumina and silica bearing materials.

Conventionally, aluminum-silicon alloys are prepared by forming commercially pure aluminum in an electrolytic cell using alumina derived from bauxite and adding to the aluminum so formed relatively pure silicon prepared independently. However, because of the number of steps involved, this type of process results in the alloy obtained being relatively expensive.

In the prior art, it is known that aluminum-silicon alloys can be made in a furnace from ores containing alumina and silica. For example, Frey et al in U.S. Pat. No. 3,661,561 disclose a process for producing aluminum-silicon alloys in a blast furnace using carbon, an alumina-silica ore and pure oxygen. According to the patent, hot oxygen reacts with carbon to form carbon monoxide gas to maintain temperatures in excess of 2050° C in the reaction zone of the furnace. Also, Seth et al in U.S. Pat. No. 3,661,562 disclose a process for producing aluminum-silicon alloys in a blast furnace having two reaction zones. This process requires that hot carbon monoxide gas formed from carbon and oxygen in a first zone be introduced to a second zone containing coke and alumina-silica ore. The hot carbon monoxide gases sweeping up through the second zone provide the necessary heat to produce the aluminum-silicon alloy. Also, in the prior art, Wood in U.S. Pat. No. 3,758,289 discloses a two-step process for producing aluminum-silicon alloy from alumina containing ores. In the first step, silica in the ore is reduced providing a product containing silicon carbide. This process requires that the product formed in the first step be transferred and heated in an electric arc furnace where the silicon carbide is converted to elementary silicon and the alumina is converted to elementary aluminum. However, in these processes gases formed can sweep through the reducing steps, resulting in substantial product loss by the sweeping effect of the gases.

The present invention substantially avoids the problem of product loss by the use of controlled reaction steps in producing aluminum-silicon alloy from alumina and silica containing ore.

SUMMARY OF THE INVENTION

An object of this invention is the carbothermic production of aluminum-silicon alloys.

Another object of this invention is the carbothermic production of aluminum-silicon alloys from alumina-silica bearing materials.

Yet another object of the invention is the carbothermic production of aluminum-silicon alloys by the controlled reaction of alumina, silica and carbon.

In accordance with these objectives, aluminum-silicon alloys are formed by bringing a mix containing sources of alumina, silica and carbon to a temperature in the range of 1500° to 1600° C to form silicon carbide and carbon monoxide. The mix containing silicon carbide is then brought to a temperature in the range of 1600° to 1900° C, preferably 1700° to 1900° C, to form aluminum oxycarbide and carbon monoxide. Thereafter, the mix containing silicon carbide and aluminum oxycarbide is brought to a temperature in the range of 1950° to 2200° C to form the aluminum-silicon alloy. Carbon monoxide formed during each reactive step only passes through that or prior reactive steps, thus maximizing the amount of metal product obtained.

DETAILED DESCRIPTION OF THE PREFERRED EMBODIMENTS

In accordance with the present invention aluminum-silicon alloy is carbothermically produced from a mixture of carbon and alumina-silica bearing materials by reacting these materials in three stages. In the first stage, the mixture is reacted at a temperature in the range of 1500° to 1600° C to form silicon carbide and carbon monoxide. In the second stage, the mixture containing the silicon carbide is then subjected to a temperature in the range of 1600° to 1900° C to form aluminum oxycarbide and carbon monoxide and in the third stage, the silicon carbide and the aluminum oxycarbide are subjected to a temperature in the range of 1950° to 2200° C to form aluminum-silicon alloy. By staging the reaction in this fashion, carbon monoxide and other gaseous effluent formed during the 1500° to 1600° C treatment can be removed without passing through materials formed during the following higher temperature treatments. Also, carbon monoxide or other gaseous effluent formed during the 1600° to 1900° C treatment can be removed without passing through the alloy producing stage. Thus, loss of alloy product due to gaseous effluent sweeping through the alloy producing stage is substantially avoided.

Alumina and silica bearing materials referred to include ores such as anorthosite, nepheline, dawsonite, bauxite, laterite and shale. Other materials which can be used as a source of alumina include ash and coal refuse. The alumina-silica bearing materials referred to and other materials useful in the invention are tabulated below along with typical composition ranges in weight percent:

TABLE I

| | ALUMINOUS RAW MATERIALS - RANGES OF CHEMICAL COMPOSITION (wt.%) | | | | | | | |
|---|---|---|---|---|---|---|---|---|
| Raw Material | $Al_2O_3$ | $SiO_2$ | $Fe_2O_3$ | $TiO_2$ | CaO | MgO | $Na_2O$ | $K_2O$ |
| Anorthosite (Average) | 16.1–32.72 (25.72) | 45.78–60.7 (54.54) | 0.15–9.90 (0.83) | 0.02–3.21 (0.52) | 5.0–18.72 (9.62) | 0.02–6.43 (0.83) | 0.68–7.11 (4.66) | 0.03–3.1 (1.06) |
| Nepheline Bearing Rocks (Average) | 12.4–27.10 (21.30) | 38.35–60.03 (55.38) | 1.54–8.64 (2.42) | 0.40–2.6 (0.66) | 0.36–19.94 (1.98) | 0.22–5.99 (0.57) | 3.72–9.72 (8.84) | 0.25–9.54 (5.34) |
| Leucite Bearing Rocks (Average) | 7.90–20.29 (16.05) | 39.28–51.93 (47.05) | 3.17–7.59 (3.49) | 0.20–4.29 (1.54) | 1.65–12.36 (10.80) | 0.22–17.58 (6.20) | 0.90–8.49 (2.35) | 4.98–9.81 (5.38) |
| Alumitized Rocks | 17.58–29.45 | 0.22–65.80 | 0.02–10.37 | 0.05–3.80 | 0.05–0.26 | 0.01–1.0 | 0.16–4.72 | 0.71–10.46 |
| Dawsonite Bearing Rocks | 9.78–13.81 | 35.1–53.3 | 3.67–4.82 | | 14.8–33.9 | 7.0–13.43 | 1.6–4.4 | 1.6–4.5 |
| $AlPO_4$ Bearing Rocks | 5.98–14.9 | 40.92–69.46 | 1.32–2.86 | 0.31–0.65 | 0.20–8.98 | 0.01– | 0.03–0.23 | 0.00– |

TABLE I-continued

| Raw Material | ALUMINOUS RAW MATERIALS - RANGES OF CHEMICAL COMPOSITION (wt.%) | | | | | | | |
|---|---|---|---|---|---|---|---|---|
| | $Al_2O_3$ | $SiO_2$ | $Fe_2O_3$ | $TiO_2$ | CaO | MgO | $Na_2O$ | $K_2O$ |
| Bauxite | 33.15–61.51 | 0.4–38.60 | 0.96–28.90 | 0.67–4.08 | 0.00–6.7 | 0.00–0.34 | 0.00–0.16 | 0.00–0.34 |
| Laterites | 15.1–44.1 | 2.25–68.0 | 3.8–60.00 | 0.16–6.40 | 0.47–2.80 | 0.23–1.66 | | |
| Hi-Alumina Shales | 11.36–39.50 | 45.60–78.63 | 0.67–6.74 | 0.50–0.93 | 0.10–8.90 | 0.84–3.52 | 0.11–1.92 | 2.21–5.0 |
| Coal Waste-Ash Analysis | 8.0–38.2 | 15.0–68.7 | 1.30–56.3 | 0.5–4.7 | >0.02–36.0 | 0.2–10.8 | 0.1–8.2 | 0.1–4.7 |
| Coal and Lignite Fly Ash | 2.2–36.3 | 4.8–68.7 | 1.9–36.3 | 0.56–1.09 | 2.54–49.81 | 0.2–25.5 | 0.2–9.0 | 0.2–1.42 |

It will be noted that materials such as anorthosite, nepheline, leucite and dawsonite, have substantial amounts of CaO, MgO, $Na_2O$ and $K_2O$ present. It should also be noted that anorthosite which comprises a mixture of anorthite ($CaOAl_2O_32SiO_2$) and albite ($NaAlSi_3O_8$) is a preferred source of alumina in the present invention.

In order to effect economic carbothermic reduction of the alumina-silica bearing material and thus produce a high yield of aluminum-silicon alloy, the silica-alumina content of the material must have a weight ratio which falls within the range of 0.15 to 1.1, and preferably in the range of 0.7 to 1.0, with a highly suitable ratio being about 0.9. The ratio of 0.7 to 1.0 is preferred for several reasons. With a ratio lower than 0.7 there is a tendency to form aluminum carbide which lowers the overall yield. Also, with higher ratios, i.e. with greater amounts of silica present, the amount of adjusting to provide the ore in the preferred ratio range is greatly diminished, particularly in the case where the silica content is high, as in low grade alumina ores. That is, the higher silica to alumina ratios are much more favorable from an economic standpoint. Also, the higher ratios provide higher product yields.

Materials low in alumina as referred to herein are those typified by having an alumina content less than 35 wt.% and typically having an alumina content in the range of 8 to 35 wt.%. Such low alumina containing materials normally have silica present from 25 to 65 wt.%.

For materials low in alumina, e.g. anorthosite, or low in silica, e.g. bauxite, the silica-alumina ratio can be adjusted to fall within the weight ratio range referred to above. If anorthosite, having silica to alumina ratio of about 2.15, is used as a starting material, this ratio can be adjusted into the range referred to by the addition of an alumina rich ore, i.e. preferably low in silica, for example bauxite. The bauxite used for such adjustment should preferably contain not less than 35 wt.% alumina. Further, preferably, the bauxite should contain alumina in the range of 40 to 55 wt.% and silica in the range of 0.1 to 15 wt.%. It is also preferred to have substantial amounts of iron oxide present either in the material used for adjusting, e.g. bauxite, or in the starting material. Typically, iron oxide can be present in the range of 0.5 to 30 wt.%. The presence of iron oxide results in iron being present in the alloy which is believed to lower the volatility of the alloy as it is produced, consequently resulting in higher product yields. Purified forms of materials rich in alumina, e.g. bauxite, can also be used but on a much less preferred basis because of the extra steps and expense involved in purifying and because the yield obtained is normally lower.

Another method of adjusting the ratio within the range referred to includes removing the silica as by physical beneficiation or by leaching. For example, alpha quartz constituting a large percentage of the silica in anorthosite can be removed to a degree which minimizes its effect by treating the ore with hydrofluoric acid. For purposes of removing the silica, the hydrofluoric acid should be in the range of 1 to 10 wt.%. The temperature of the leaching solution should be in the range of 60° to 100° C and the time of leaching should be in the range of ½ to 3 hours. In employing hydrofluoric acid to leach anorthosite, the silica to alumina weight ratio can be lowered from 2.2 to 1.4 by a 10 wt.% HF solution at 100° C for 1 hour. Thus, the amount of alumina rich ore which may be required to provide the desired ratio is lowered significantly.

With respect to shale or fly ash, the silica content therein can be lowered by leaching with hydrofluoric acid, for example, to provide the desired silica to alumina ratio. It will be noted that the higher ratios are very favorable with respect to leaching of silica since the extent of leaching is significantly diminished.

In yet another method of providing silica-alumina in the weight ratio referred to above, silica can be added. For example, if bauxite, having a silica-alumina weight ratio in the range of 0.02 to 0.05, is used as the alumina-silica bearing material, a source of silica can be added to provide the desired weight ratio.

It will be appreciated that a combination of these steps for adjusting the silica-alumina weight ratio may be employed. That is, the ore, for example, can be partially leached to remove silica and thereafter bauxite can be added to the partially leached ore in order to bring it within the silica-alumina weight ratio range.

In preparing an ore for use in the present invention, it should be ground to a mesh size in the range of −14 to −200 (Tyler Series) with a preferred range being −28 to −100 (Tyler Series). Prior to the alumina-silica bearing material being adjusted within the weight ratio noted above, it is preferred that such material be subjected to initial beneficiation or mechanical separation such as a flotation process or heavy media or magnetic separation for purification purposes. When the ore is anorthosite, for example, it is preferred that it be subjected to a hydrochloric acid purification treatment to remove calcium oxide (CaO) and sodium oxide ($Na_2O$) and the like. For such treatment, the hydrochloric acid should have a concentration in the range of 5 to 20 wt.% and the temperature should be in the range of 60° to 100° C. A typical time for such treatment is in the range of ½ to 3 hours. After such treatment the ore may be washed with water. This purification treatment can be combined with the acid leaching step to remove silica.

For purposes of reduction, a mix containing the silica-alumina in the desired ratio and carbonaceous material should be provided. Such mix should contain 15 to 30 wt.% carbonaceous material based on the carbon content of the material with a preferred amount being 19 to 28 wt.%. When alumina-silica bearing materials such as shale are used, a certain amount of carbonaceous material can be present in the shale, thus the amount of reducing material to be added is lowered. The carbonaceous material referred to includes coke, a preferred source of which is metallurgical coke, since it has a high porosity which favors the reduction reaction. The mix can be reduced in a blast furnace or electric furnace, with the blast furnace technique being preferred because of economics. For purposes of reduction and heating in a blast furnace, additional carbonaceous material should be provided. Thus, in addition to the carbonaceous material provided for reduction, 40 to 60 wt.% carbonaceous material should be provided for heating purposes in the blast furnace.

When the alumina-silica bearing material is oil shale, it is preferred to remove materials such as volatile hydrocarbons. Thus, prior to adjusting the silica-alumina ratio, it is preferred to treat the shale to remove such materials. Such treatments can include physical or chemical beneficiation and carbonization to remove the volatiles and to coke the carbonaceous material therein. The presence of coke already in the shale, as noted above, reduces the amount of reducing material to be added.

In accordance with the principles of the present invention, the process is controlled in order to effect the production of aluminum-silicon alloys substantially according to the following reactions:

(a) $3SiO_2 + 9C \rightarrow 3SiC + 6CO$ (b) $2Al_2O_3 + 3C \rightarrow Al_4O_4C + 2CO$ (c) $Al_4O_4C + 3SiC \rightarrow 4Al + 3Si + 4CO$ Reactions (a), (b) and (c) are effected at temperatures in the range of 1500° to 1600° C, 1600° to 1900° C and 1950° to 2200° C, respectively. That is, the process of the invention must be controlled within these temperature ranges in order that the materials used to produce the aluminum-silicon alloy react according to this sequence. Thus, for example, if the aluminum-silicon alloy is produced continuously in a furnace, alumina, silica and carbon introduced at the top thereof would be heated to a temperature in the range of 1500° to 1600° C in order to effect reaction (a). Heating at this temperature should take place in a zone adjacent the top of the furnace. This heated zone allows carbon monoxide to escape without sweeping through the subsequent or higher temperature zones. So too, when reaction (b) is effected, carbon monoxide formed is also removed without its sweeping through the alloy producing zone.

Minimizing the carbon monoxide gas sweeping or passing through the zones is an important aspect of this invention. That is, if a large volume of gaseous material is permitted to pass through the zones, especially the metal producing zone, only a very small amount of aluminum-silicon alloy is obtained. Thus, it will be understood that the absence of temperature zones in the furnace can result in the loss of valuable product since gaseous material passing through the metal producing zone removes a substantial amount of alloy product.

With reference to the reactions in the present invention, it should be noted that the amount of carbon monoxide produced in the low temperature zone amounts to about ½ that produced in the furnace. Also, only 1/6 of the carbon monoxide is produced in the intermediate temperature zone. Thus, ½ of the total carbon monoxide gas produced does not sweep or pass through the aluminum-silicon producing zone, resulting in a high product yield.

Measurement of the volume percent of carbon monoxide gas evolved from a charge of alumina-silica bearing material and carbon heated in an electric furnace from room temperature to about 2100° C showed that the evolution of carbon monoxide gas peaks at about 1580° C, indicating the formation of silicon carbide and carbon monoxide in accordance with reaction (a). Also, it was found that carbon monoxide gas peaks again at about 1780° C, in conformance with reaction (b), and peaks a third time at about 2080° C, indicating the formation of the aluminum-silicon alloy.

Controlling the reactions within these temperature zones not only serves to minimize the sweeping effect of the carbon monoxide gas evolved during the reduction of alumina and silica, but it also serves to minimize the effect of carbon monoxide evolved from other sources. That is, for example, óxide impurities contained in the ore such as $Fe_2O_3$, $K_2O$, $Na_2O$, $TiO_2$, MgO and CaO can be reduced with the accompanying evolution of carbon monoxide. Thus, it can be seen that it is highly beneficial to remove such carbon monoxide without its passing through the alloy producing stage.

It should be noted that while it is desirable to control the volatiles emanating from the furnace so that they do not interfere with the production or yield of the aluminum-silicon alloy in the third stage, a certain amount of volatilization is inherent in the process and indeed can be beneficial as long as it is controlled. Thus, carbon monoxide evolved from the reduction reaction and from heating along with SiO, $Al_2O$, Si and Al in vaporous form can serve to preheat the incoming feed. In preheating the feed, SiO, $Al_2O$ and Al can be recovered by condensation on the feed and thereby returned to the furnace. Thus, minimizing the sweeping effect of carbon monoxide gas through the alloy producing zone in combination with the controlled temperature reaction zones and with the condensation of volatiles on the feed serve to maximize the yield of aluminum-silicon alloy obtainable from alumina-silica bearing materials.

The heat input to or temperature of the reaction zones referred to can be controlled by the amount of oxygen provided in each zone when a blast furnace is used. That is, the temperature of each zone can be regulated by controlling the amount of oxygen available in each zone to burn with carbon provided for heating purposes. Thus, the amount of oxygen available in the low temperature zone (1500°-1600° C) determines the amount of carbon burnt in that zone. The next or hotter zone (1600°-1900° C) can also be controlled by the amount of oxygen available for burning with carbon. The hottest zone (1950°-2200° C) may be controlled in substantially the same way.

One of the important advantages of the present invention resides in the fact that comparatively inexpensive materials can be used to produce the heat necessary to effect the reactions. That is, effecting the reactions in the order indicated above permits the production of the aluminum silicon alloy in accordance with blast furnace principles. In addition, effecting the reactions as indicated hereinabove permits the use of air as the source of oxygen in at least the first two zones. Oxygen enriched air may be used in the first two zones if desired.

With respect to the third or hottest zone, because of the controlled prior reaction steps, it may be heated by burning relatively pure oxygen with carbon without appreciable loss of metal product. The use of oxygen serves to minimize the gases evolving from this stage and also aids in maximizing the alloy product yield. It will be appreciated that this zone may be heated electrically either by arc furnace or resistance furnace principles to further minimize or reduce the evolution of gases therefrom. However, because electrical heating can result in unfavorable economics, such heating is suitable on a much less preferred basis.

Another important aspect of this invention resides in the addition of carbon to the blast furnace. For at least purposes of heating, in a preferred embodiment, carbon may be introduced to the respective zones, preferably along with the source of oxygen. Addition of the carbon in this manner has the advantage of providing further controls with respect to temperature for the respective zones. That is, by knowing the feed rate of alumina and silica bearing materials to the furnace, a controlled amount of oxygen and carbon can be added to each zone to provide the temperature required therein. This method also has the advantage that carbon for burning purposes does not have to be carried through prior stages.

Carbon to be added with the oxygen is preferably in the form of coke which is ground to a powdery form and is capable of being carried along with air or oxygen.

An advantage of staging the reactions in this manner permits the use of a charge wherein the silica to alumina weight ratio can vary quite extensively as compared to that usable in conventional operations. That is, the present invention permits the use of silica-alumina weight ratios in the charge in the order of 0.2 to 0.5 without serious adverse effects. These lower weight ratios are highly advantageous in that low or marginal grade bauxite, e.g. having higher amounts of silica, typically 5% or more, can be used. With the lower weight ratios, the amount of silica to be added to such low grade bauxites for use in the present invention is reduced.

While the invention has been described in terms of preferred embodiments the claims appended hereto are intended to encompass other embodiments which fall within the spirit of the invention.

Having thus described the invention and certain embodiments thereof, we claim:

1. A method of carbothermically producing an aluminum-silicon alloy from alumina and silica bearing materials, the method comprising:

a. bringing a mix containing sources of alumina, silica and carbon to a temperature in the range of 1500° to 1600° C to form silicon carbide and carbon monoxide;

b. bringing said mix containing said silicon carbide to a temperature in the range of 1600° to 1900° C to form aluminum oxycarbide and carbon monoxide;

c. bringing said silicon carbide and said aluminum oxycarbide to a temperature in the range of 1950° to 2200° C to form said aluminum-silicon alloy;

d. removing said carbon monoxide formed in step (a) without its passing through materials in steps (b) and (c); and e. removing said carbon monoxide formed in step (b) without its passing through materials in step (c).

2. The method according to claim 1 wherein the mix contains carbon in the range of 15 to 30 wt.% for reduction purposes.

3. The method according to claim 1 wherein said alumina and silica bearing materials are ground to a size in the range of −14 to −200 mesh (Tyler Series).

4. The method according to claim 1 wherein in step (a) the silica and alumina are provided in a weight ratio in the range of 0.15 to 1.1.

5. The method according to claim 4 wherein the alumina and silica bearing materials have a low alumina content, and said ratio is provided by adding to said alumina and silica bearing material an ore rich in alumina and low in silica.

6. The method according to claim 5 wherein said alumina rich ore is bauxite having not less than 35 wt.% alumina and not more than 15 wt.% silica.

7. The method according to claim 4 wherein the alumina and silica bearing material is rich in alumina and has a silica content in the range of 0.1 to 15.0 wt.% and said ratio is provided by adding to said material a source of silica.

8. The method according to claim 4 wherein said alumina and silica bearing material contains 25 to 65 wt.% silica and said weight ratio is obtained by preferential removal of silica therefrom.

9. The method according to claim 8 wherein said removal of silica is accomplished by leaching with a solution containing hydrofluoric acid.

10. The method according to claim 4 wherein said alumina and silica bearing material is anorthosite.

11. A method of carbothermically producing an aluminum-silicon alloy from alumina and silica bearing materials, the method comprising:

a. providing alumina and silica bearing materials and carbon in a mix, the weight ratio of silica to alumina in the mix being in the range of 0.15 to 1.1, the mix containing 15 to 30 wt.% carbon, the weight ratio being provided by combining an alumina poor ore with an alumina rich ore;

b. reacting said mix at a temperature in the range of 1500° to 1600° C to form silicon carbide and carbon monoxide;

c. reacting said mix containing said silicon carbide in a second zone at a temperature in the range of 1600° to 1900° C to form aluminum oxycarbide and carbon monoxide;

d. reacting said silicon carbide and said aluminum oxycarbide at a temperature in the range of 1950° to 2200° C to form said aluminum-silicon alloy;

e. removing said carbon monoxide formed in step (b) without its passing through materials in steps (c) and (d); and f. removing said carbon monoxide formed in step (c) without its passing through materials present in step (d).

12. A method of carbothermically producing an aluminum-silicon alloy from alumina and silica bearing materials in a furnace, the method comprising:

a. providing a mix containing sources of alumina, silica and carbon in a first zone in the furnace having a temperature in the range of 1500° to 1600° C to form silicon carbide and carbon monoxide, the mix containing carbon in the range of 15 to 30 wt.% for reduction purposes;

b. providing said mix containing said silicon carbide in a second zone having a temperature in the range of 1600° to 1900° C to form aluminum oxycarbide and carbon monoxide;

c. providing said silicon carbide and said aluminum oxycarbide in a third zone having a temperature in the range of 1950° to 2200° C to form the aluminum-silicon alloy, the zones being heated by burning a source of carbon and a source of oxygen;

d. removing the carbon monoxide formed in step (a) without its passing through materials in steps (b) and (c); and e. removing carbon monoxide formed in step (b) without its passing through materials in step (c).

13. The method according to claim 12 wherein the amount of carbon added to the furnace for purposes of obtaining said temperatures is 40 to 60 wt.% of said mix.

14. The method according to claim 12 wherein carbon and oxygen are employed to heat the first and second zones and electricity is employed to heat the third zone.

15. The method according to claim 12 wherein carbon and the source of $O_2$ employed for heating purposes are added to said first zone in an amount sufficient to maintain said first zone in the temperature range of 1500° to 1600° C.

16. The method according to claim 12 wherein carbon and the source of $O_2$ employed for heating purposes are added to said second zone in an amount sufficient to maintain said second zone in the temperature range of 1600° to 1900° C.

17. The method according to claim 12 wherein carbon and the source of $O_2$ employed for heating purposes are added to said third zone in an amount sufficient to maintain said third zone in the temperature of 1950° to 2200° C.

18. The method according to claim 15 wherein the source of oxygen is air.

19. The method according to claim 16 wherein the source of oxygen is air.

20. The method according to claim 17 wherein the source of oxygen is substantially $O_2$.

21. A method of carbothermically producing an aluminum-silicon alloy from alumina and silica bearing materials in a furnace the method comprising:

a. providing a mix containing sources of alumina, silica and carbon in a first zone in the furnace having a temperature in the range of 1500° to 1600° C to form silicon carbide and carbon monoxide, the mix containing carbon in the range of 15 to 30 wt.% for reduction purposes;

b. adding to said first zone, carbon and air in an amount sufficient to maintain said zone in the temperature range of 1500° to 1600° C;

c. providing said mix containing said silicon carbide in a second zone having a temperature in the range of 1600° to 1900° C to form aluminum oxycarbide and carbon monoxide;

d. adding to said second zone, carbon and air in an amount sufficient to maintain said zone in the temperature range of 1600° to 1900° C;

e. providing said silicon carbide and said aluminum oxycarbide in a third zone having a temperature in the range of 1950° to 2200° C to form aluminum-silicon alloy;

f. adding to said third zone carbon and substantially pure oxygen in an amount sufficient to maintain said zone in the temperature range of 1950° to 2200° C;

g. removing gases resulting from heating and reducing in steps (a) and (b) without such gases passing through materials in steps (c) and (e); and h. removing gases resulting from heating and reducing in steps (c) and (d) without such gases passing through materials in step (e).

22. The method according to claim 21 wherein the carbon and oxygen added in steps (d) and (f) do not pass through prior steps.

23. The method according to claim 21 wherein the carbon added in steps (b), (d) and (f) is in finely divided form.

24. The method according to claim 23 wherein the carbon employed in steps (b), (d) and (f) is mixed with said air and oxygen added in said steps.

25. A method of carbothermically producing an aluminum-silicon alloy from alumina and silica bearing materials in a furnace the method comprising:

a. providing a mix containing sources of alumina, silica and carbon in a first zone in the furnace having a temperature in the range of 1500° to 1600° C to form silicon carbide and carbon monoxide, the mix containing carbon in the range of 15 to 30 wt.% for reduction purposes and having silica to alumina in a weight ratio therein in the range of 0.15 to 1.1, the ratio being provided by adjusting the amount of either the alumina or silica in said materials;

b. adding to said first zone, carbon mixed with air in an amount sufficient to maintain said zone in the temperature range of 1500° to 1600° C;

c. providing said mix containing said silicon carbide in a second zone having a temperature in the range of 1600° to 1900° C to form aluminum oxycarbide and carbon monoxide;

d. adding to said second zone, carbon mixed with air in an amount sufficient to maintain said zone in the temperature range of 1600° to 1900° C;

e. providing said silicon carbide and said aluminum oxycarbide in a third zone having a temperature in the range of 1950° to 2200° C to form aluminum-silicon alloy;

f. adding to said third zone, carbon mixed with substantially pure oxygen in an amount sufficient to maintain said zone in the temperature range of 1950° to 2200° C;

g. removing gases resulting from heating and reducing in steps (a) and (b) without such gases passing through materials in steps (c) and (e); and h. removing gases resulting from heating and reducing in steps (c) and (d) without such gases passing through materials in step (e).

* * * * *